US011015836B2

(12) United States Patent
Post et al.

(10) Patent No.: US 11,015,836 B2
(45) Date of Patent: May 25, 2021

(54) WATER HEATER BLOWER ASSEMBLY HAVING A LOW EXHAUST PORT

(71) Applicant: Regal Beloit America, Inc., Beloit, WI (US)

(72) Inventors: Steven W. Post, Cassville, MO (US); Jeffrey Jay Long, Purdy, MO (US); William S. Gatley, Jr., Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 520 days.

(21) Appl. No.: 15/183,040

(22) Filed: Jun. 15, 2016

(65) Prior Publication Data

US 2017/0363322 A1 Dec. 21, 2017

(51) Int. Cl.

| | |
|---|---|
| ***F24H 9/00*** | (2006.01) |
| ***F23L 17/00*** | (2006.01) |
| ***F24H 1/20*** | (2006.01) |

(52) U.S. Cl.

CPC ..... *F24H 9/0031* (2013.01); *F23L 17/005* (2013.01); *F24H 1/205* (2013.01)

(58) Field of Classification Search

CPC ..... F23L 17/005; F24H 1/205; F24H 9/0031
USPC ..... 122/14.2, 14.21, 17.1, 19.2
See application file for complete search history.

(56) References Cited

U.S. PATENT DOCUMENTS

| | | | | |
|---|---|---|---|---|
| 4,603,680 | A | 8/1986 | Dempsey et al. | |
| 4,750,433 | A * | 6/1988 | Guzorek | F23L 17/005 110/162 |
| 4,867,106 | A | 9/1989 | Staats | |
| 4,899,726 | A | 2/1990 | Waterman | |
| 7,354,244 | B2 * | 4/2008 | Hasbargen | F23L 17/005 415/212.1 |
| 2004/0258546 | A1 * | 12/2004 | Gatley, Jr. | F04D 25/06 417/423.14 |
| 2008/0131283 | A1 | 6/2008 | Elsaesser et al. | |
| 2012/0180737 | A1 | 7/2012 | English et al. | |
| 2014/0137812 | A1 * | 5/2014 | Branecky | G05D 7/0676 122/14.21 |

* cited by examiner

*Primary Examiner* — Steven B McAllister
*Assistant Examiner* — Benjamin W Johnson
(74) *Attorney, Agent, or Firm* — Thompson Coburn LLP

(57) ABSTRACT

A draft inducer blower assembly for use with a water heater has a housing, a motor, and a fan. The housing has an exhaust volute surrounding the fan and a base adapted to be mounted atop a water heater. The base has an inlet port adapted to receive exhaust gas from the water heater. The fan is connected to the motor for rotation about a rotation axis. The exhaust volute and the base are non-adjustably fixed relative to each other. The exhaust volute has a cut-off at a cut-off angle relative to the rotation axis. The cut-off angle extends at an angle that is no more than twenty degrees positive from horizontal. The exhaust volute has an exhaust outlet passageway that extends to an exhaust port. The exhaust outlet passageway extends beneath the cut-off before reaching the exhaust port.

9 Claims, 7 Drawing Sheets

WATER HEATER BLOWER ASSEMBLY HAVING A LOW EXHAUST PORT

CROSS-REFERENCE TO RELATED APPLICATIONS

Not Applicable.

STATEMENT REGARDING FEDERALLY SPONSORED RESEARCH OR DEVELOPMENT

Not Applicable.

Appendix

Not Applicable.

BACKGROUND OF THE INVENTION

Field of the Invention

The present invention pertains to draft inducer blower assemblies for use with water heaters having burners and gas-fueled water heaters having a draft inducer blower assembly.

General Background

Gas-fueled water heaters typically comprise a draft inducer blower assembly that provides combustion air to the burner. A draft inducer blower assembly is most commonly attached to the top of the water heater and therefore takes up vertical space that, in some circumstances, can be a concern. Moreover, in some circumstances such blower assemblies must be connected to vertical vent lines, while in other circumstances they must be connected to horizontal vent lines.

SUMMARY OF THE INVENTION

The configuration of a draft inducer blower assembly in accordance with the present invention allows for the blower assembly to be connected to either vertical or horizontal vent lines, without altering the components of the blower assembly itself, even in situations where vertical/clearance is a concern. By not having to adjust the blower assemblies to account for specific installation needs, installation costs are reduced, as are the skills required to install water heaters provided with such a draft inducer blower assembly.

In one aspect of the invention, a draft inducer blower assembly for use with a gas-fueled water heater comprises a housing, a motor, and a fan. The housing has an exhaust volute surrounding the fan and a base configured and adapted to be mounted atop a water heater. The base has an inlet port adapted and configured to receive exhaust gas from the water heater when the base is mounted atop the water heater. The fan is connected to the motor for rotation about a rotation axis. The exhaust volute and the base are non-adjustably fixed relative to each other. The exhaust volute has a cut-off at a cut-off angle relative to the rotation axis. The cut-off angle extends at an angle that is no more than twenty degrees positive from horizontal. The exhaust volute has an exhaust outlet passageway that extends to an exhaust port. The exhaust outlet passageway extends beneath the cut-off before reaching the exhaust port.

Further features and advantages of the present invention, as well as the operation of the invention, are described in detail below with reference to the accompanying drawings.

Figure 1:
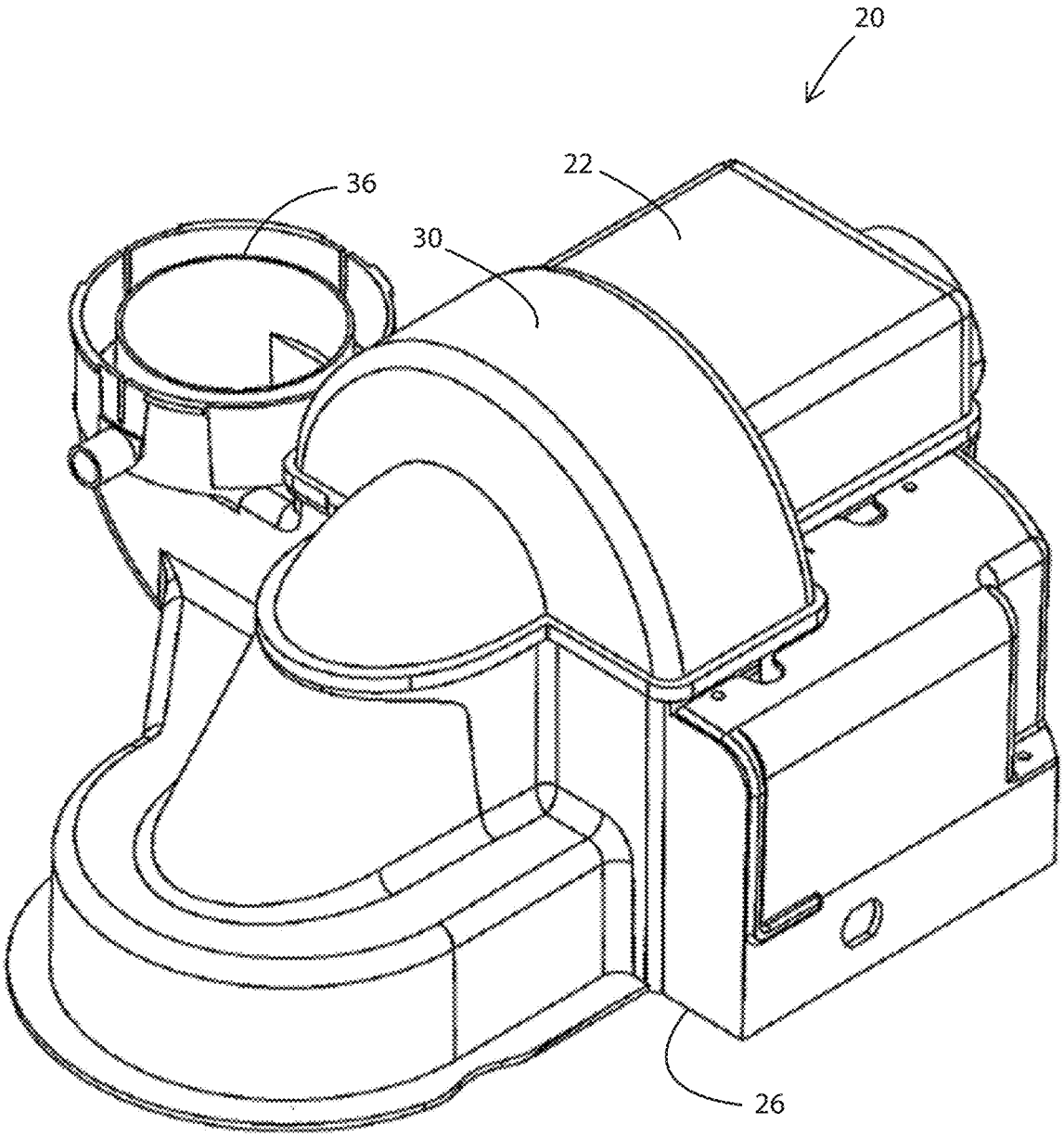
FIG. 1 is a perspective view of an embodiment of a draft inducer blower assembly in accordance with the invention.
Figure 2:
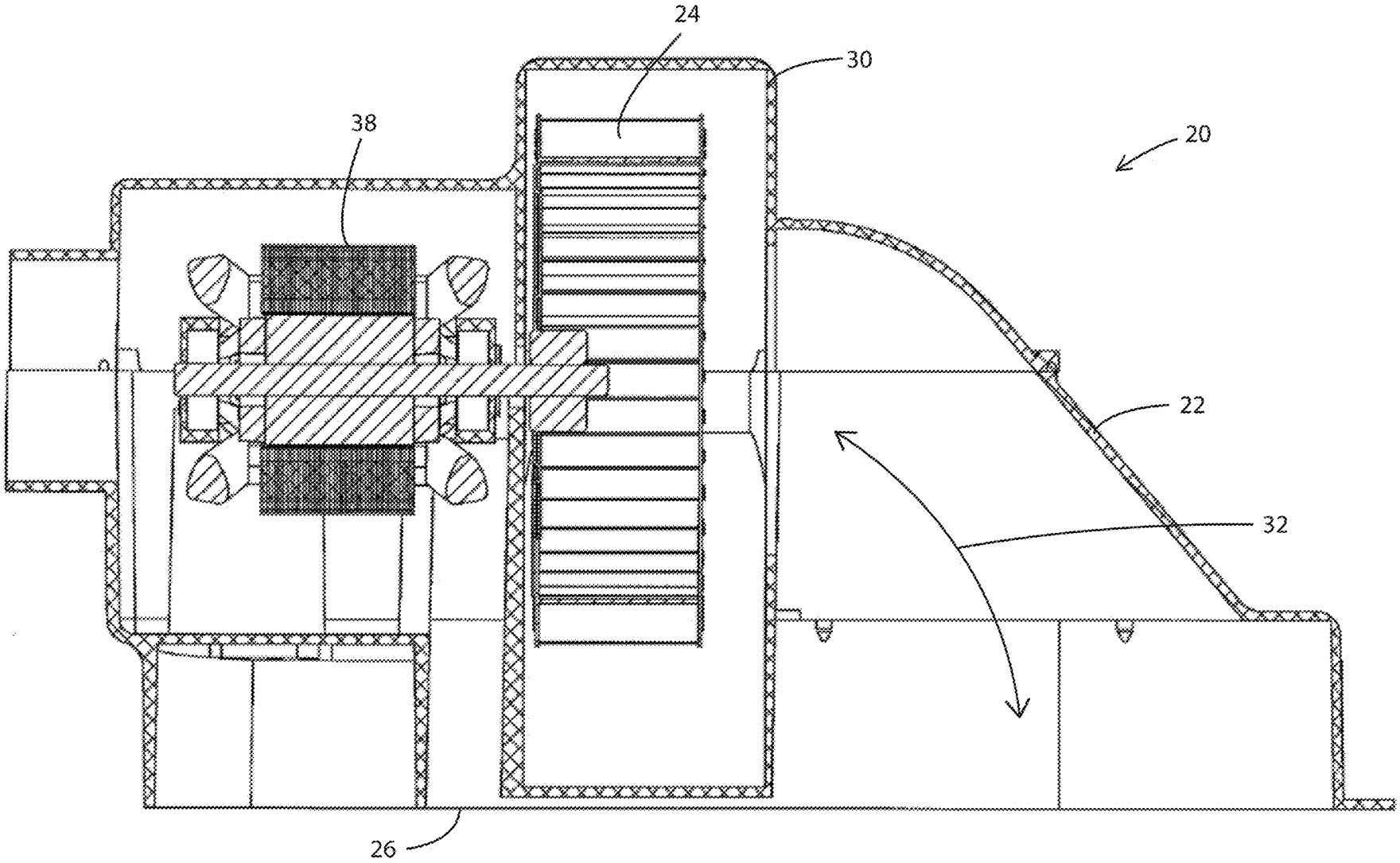
FIG. 2 is an elevational cross-sectional view of the draft inducer blower assembly shown in FIG. 1, taken about the rotation axis of the fan.

Reference numerals in the written specification and in the drawing figures indicate corresponding items.

DETAILED DESCRIPTION

Figure 7:
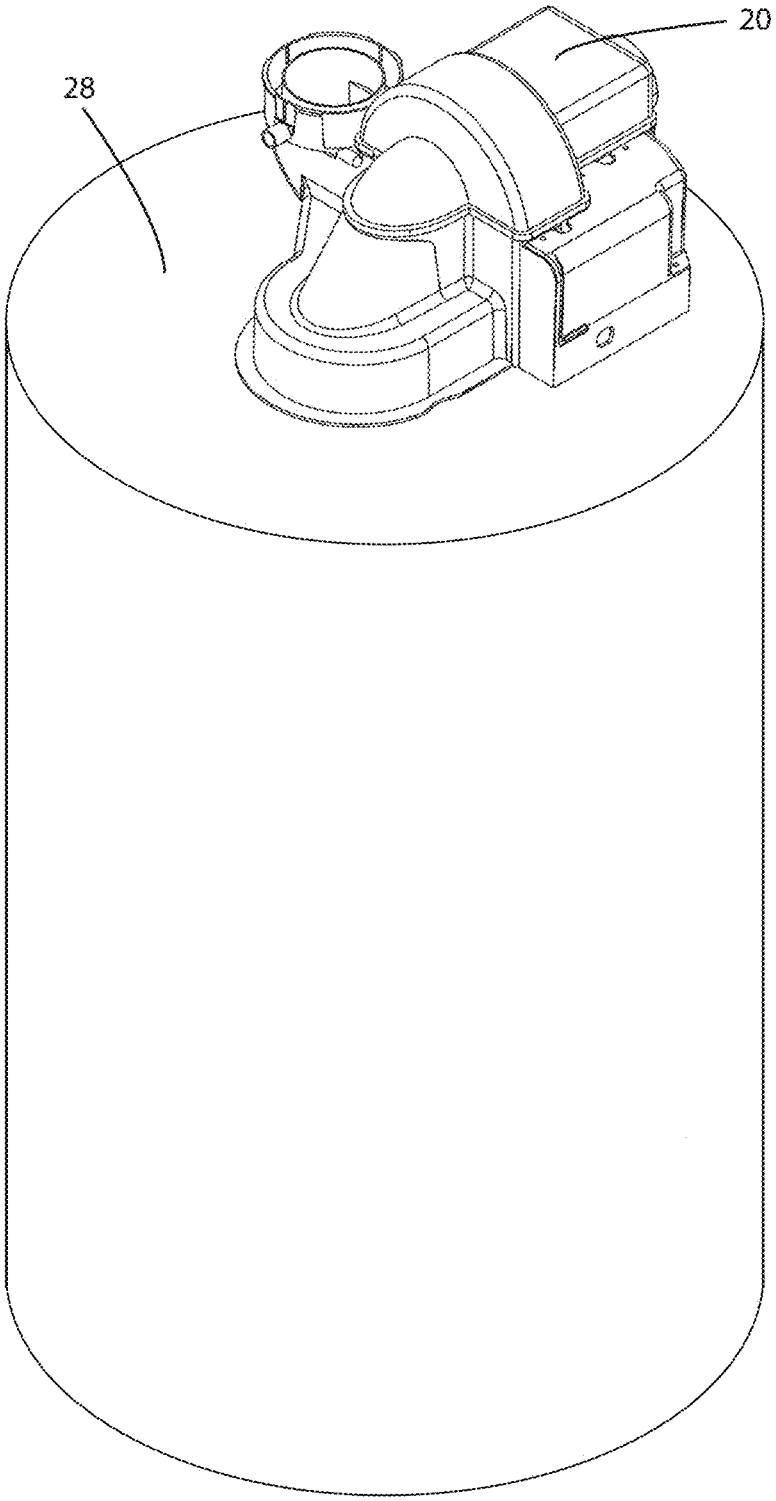
FIG. 7 is a perspective view of a water heater comprising the blower assembly shown in FIGS. 1-3.

An embodiment of a draft inducer blower assembly (20) in accordance with the invention is shown in the figures. The blower assembly (20) comprises a housing (22) that houses a fan (24). The base (26) of the housing (22) is configured to attach atop a water heater (28), as shown in FIG. 7. The housing (22) also forms an exhaust volute (30) in which the fan (24) resides. An inlet passageway (32) extends from an opening in the base of the housing to the fan (24) and is adapted to connect to the exhaust outlet (not shown) of a gas-fueled water heater. The exhaust volute (30) comprises an exhaust outlet passageway (34) that extends to an exhaust port (36). The fan (24) is attached to a motor (38) that rotationally drives the fan about a rotation axis when in use.

Figure 3:
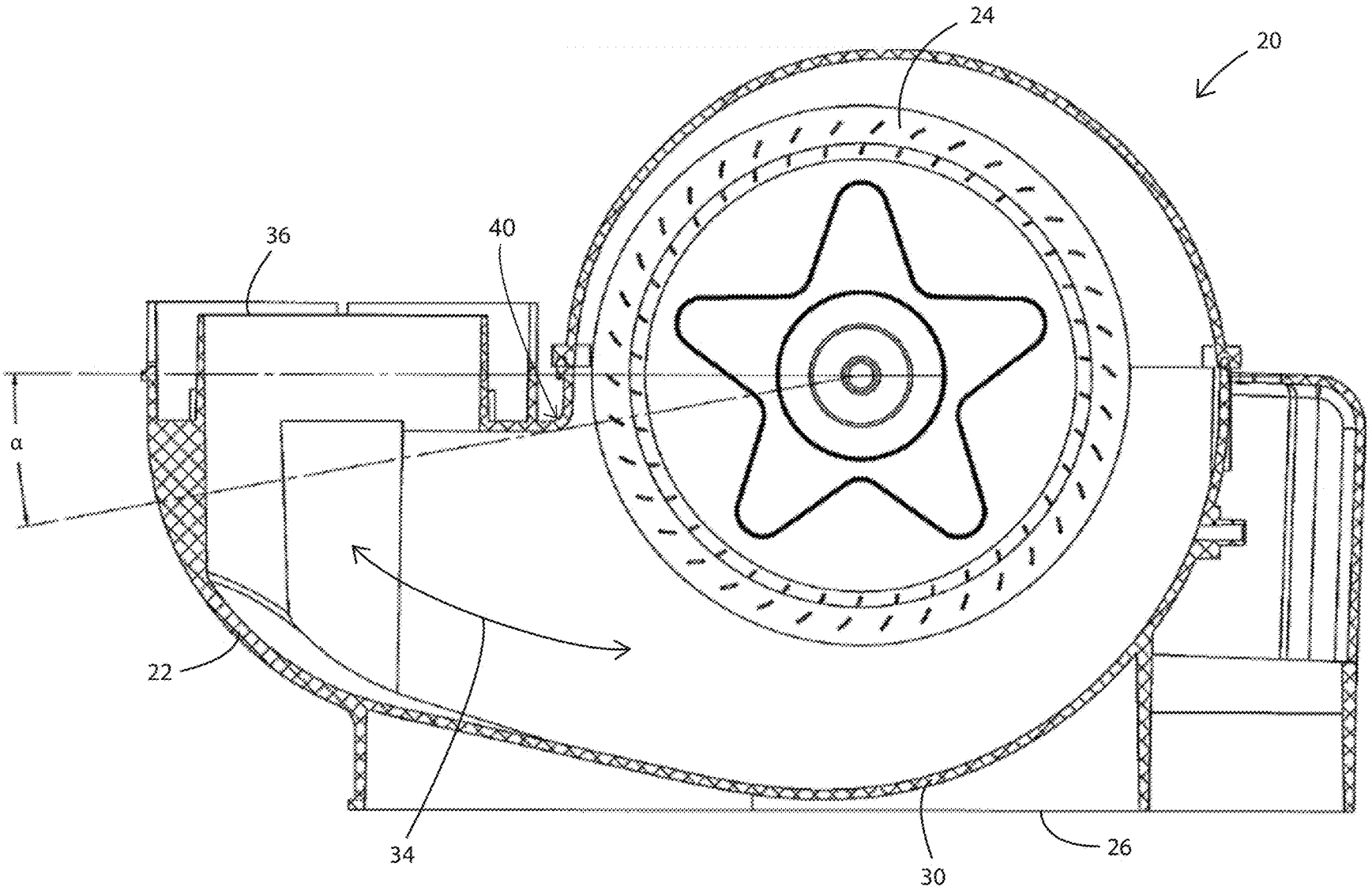
FIG. 3 is an elevational cross-sectional view of the draft inducer blower assembly shown in FIGS. 1 and 2, taken about a plane that is perpendicular to the rotation axis and that lies midway through the thickness of the volute of the blower assembly.

As shown in FIG. 3, the exhaust volute (30) has a cut-off (40) that is oriented at a cut-off angle ($\alpha$) relative to the rotation axis. The cut-off angle ($\alpha$) is appreciably low, preferably no more than twenty degrees positive from horizontal, and more preferably the cut-off angle ($\alpha$) is negative from horizontal (as is shown in FIG. 3). The exhaust outlet passageway (34) extends beneath the cut-off (40) before reaching the exhaust port (36). Preferably, the exhaust outlet passageway (34) turns upward as it extends toward the exhaust port (36) after passing beneath the cut-off (40) to the extent the exhaust port faces vertically upward. However, the exhaust outlet passageway (34) need not turn upward and the exhaust port (36) could face horizontally. Regardless, the exhaust port (36) is preferably located beneath the top of the exhaust volute (30).

Figure 4:
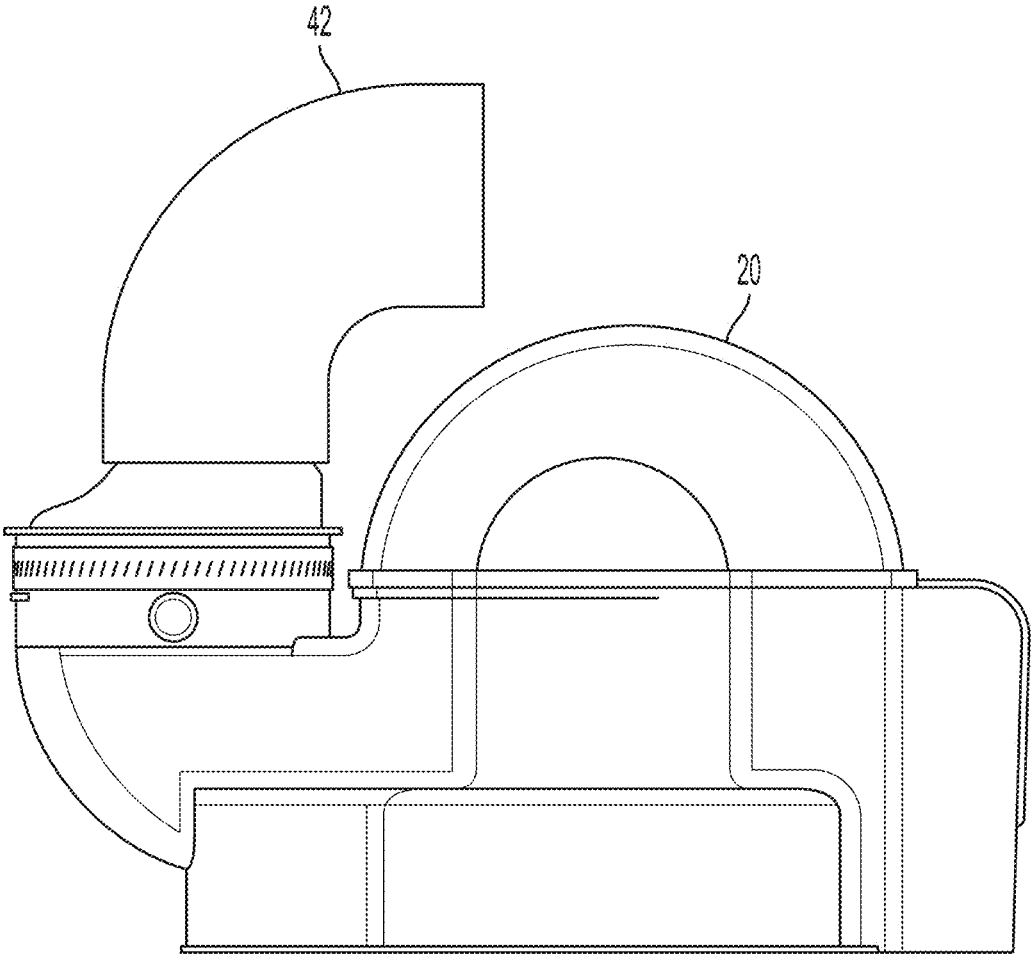
FIG. 4 is a front elevation view of the draft inducer blower assembly shown in FIGS. 1-3, showing a ninety degree pipe elbow attached to the blower assembly.
Figure 5:
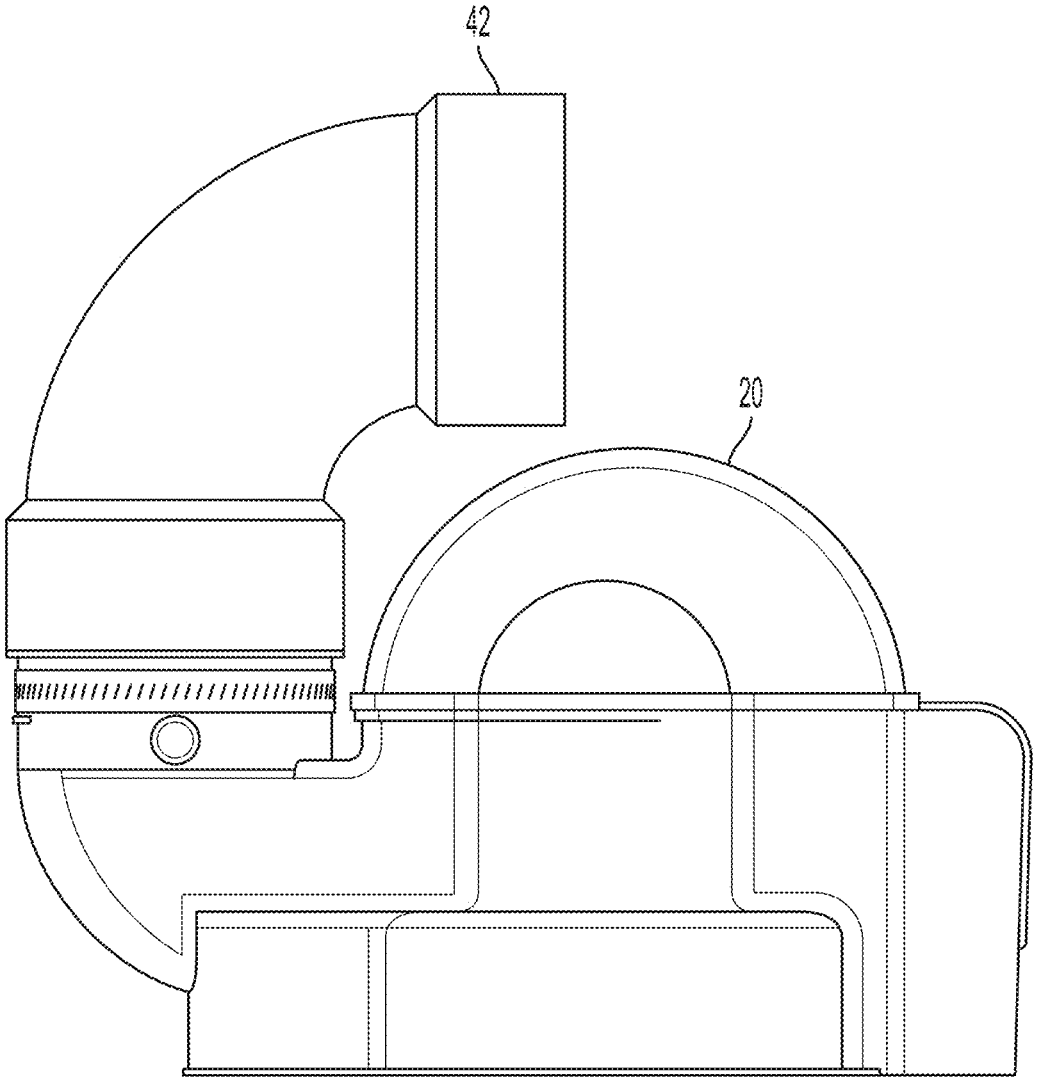
FIG. 5 is a front elevation view of the draft inducer blower assembly shown in FIGS. 1-3, showing another ninety degree pipe elbow attached to the blower assembly.
Figure 6:
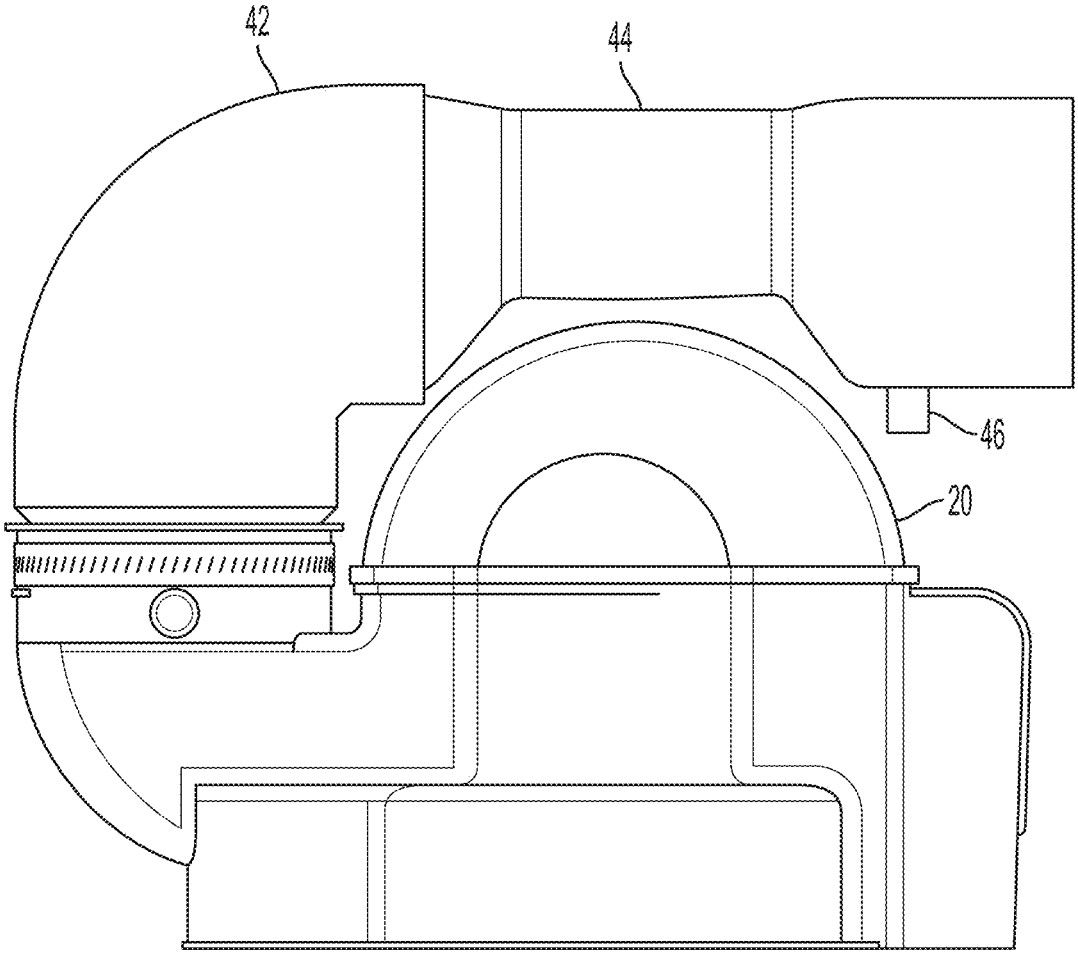
FIG. 6 is a front elevation view of the draft inducer blower assembly shown in FIGS. 1-3, showing an ultra-low ninety degree elbow and cross-over pipe attached to the blower assembly.

The configuration of the blower assembly (20) provides considerable advantages when the clearances above the tank of a water heater are limited. As shown in FIGS. 1 and 7, the blower assembly (20) is ready to be connected to a vertically oriented exhaust flue pipe (not shown). Additionally, as shown in FIGS. 4-6, the blower assembly (20) can be used with elbow flue pipe fittings (42) such that the blower assembly can be connected to horizontal flue piping. Notably and as should be appreciated from FIGS. 4-6, by providing an exhaust port (36) that lies appreciably beneath the top of the exhaust volute (30) of the housing (22), especially an exhaust port (36) that faces vertically upward, the transition to horizontal flue piping can be made just above the top of the exhaust volute (30), which is necessary in many low clearance situations. As is shown in FIG. 6, a unique cross-over pipe (44) can also be provided, which can bridge over the top of the exhaust volute (30) when clearance above a water heater tank demands a transition that is even closer to the base (26) of the blower assembly (20). The opposite ends of the cross-over pipe (44) have circular cross-sections while the bottom of the center section necks in from the bottom side and also widens so as not to create a flow restriction. The downstream end of the cross-over pipe comprises a drain (46) for water that condensates, since such water is not able to drain back to the blower assembly (20). No modification of the blower assembly (20) itself is needed to convert the blower assembly (20) from a vertical flue configuration to a horizontal flue configuration (nor can the blower assembly be modified), unlike traditional blower assemblies where the volute is typically rotatable relative to the base of the blower assembly and must often be rotated relative to the base of such blowers when clearances demand the same.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A draft inducer blower assembly for use with a gas-fueled water heater, the blower assembly comprising a housing, a motor, and a fan, the housing having an exhaust volute surrounding the fan and a base configured and adapted to be mounted atop the water heater, the base having an inlet port adapted and configured to receive exhaust gas from the water heater when the base is mounted atop the water heater, the fan being connected to the motor for rotation about a rotation axis, the exhaust volute and the base being non-adjustably fixed relative to each other, the exhaust volute having a cut-off at a cut-off angle relative to the rotation axis, the cut-off angle extending at an angle that is no more than twenty degrees positive from horizontal, the exhaust volute having an exhaust outlet passageway that extends to an exhaust port, the exhaust outlet passageway extending beneath the cut-off before reaching the exhaust port.

2. A draft inducer blower assembly in accordance with claim 1 wherein the exhaust outlet passageway extends beneath the cut-off, thereafter turns upward, and terminates at the exhaust port, and the exhaust port faces vertically upward.

3. A draft inducer blower assembly in accordance with claim 2 wherein the exhaust port is lower than a top of the exhaust volute.

4. A draft inducer blower assembly in accordance with claim 3 further comprising an elbow fitting and a cross-over pipe, the cross-over pipe being connected to the exhaust port by the elbow fitting, the cross-over pipe having an upstream section, a center section, and a downstream section, the center section having a diameter less than that of both the upstream section and the downstream section and the center section being offset from a center axis of the upstream section and the downstream section, the downstream section comprising a drain, the center section of the cross-over pipe being configured and adapted to bridge over the volute of the housing.

5. A draft inducer blower assembly in accordance with claim 1 wherein the cut-off angle is negative from horizontal.

6. A water heater comprising a draft inducer blower assembly, the blower assembly comprising a housing, a motor, and a fan, the housing having an exhaust volute surrounding the fan and a base mounted atop the water heater, the base having an inlet port adapted and configured to receive exhaust gas from the water heater, the fan being connected to the motor for rotation about a rotation axis, the exhaust volute and the base being non-adjustably fixed relative to each other, the exhaust volute having a cut-off at a cut-off angle relative to the rotation axis, the cut-off angle extending at an angle that is no more than twenty degrees positive from horizontal, the exhaust volute having an exhaust outlet passageway that extends to an exhaust port, the exhaust outlet passageway extending beneath the cut-off before reaching the exhaust port.

7. A water heater in accordance with claim 6 wherein the exhaust outlet passageway of the blower assembly extends beneath the cut-off, thereafter turns upward, and terminates at the exhaust port, and the exhaust port faces vertically upward.

8. A water heater in accordance with claim 7 wherein the exhaust port of the blower assembly is lower than a top of the exhaust volute.

9. A water heater in accordance with claim 6 wherein the cut-off angle of the exhaust volute of the blower assembly is negative from horizontal.

* * * * *